US007666283B2

(12) United States Patent
Möbius et al.

(10) Patent No.: US 7,666,283 B2
(45) Date of Patent: Feb. 23, 2010

(54) INSOLUBLE ANODE

(75) Inventors: Andreas Möbius, Kaarst (DE); Marc L. A. D. Mertens, Oss (NL)

(73) Assignee: Enthone Inc., West Haven, CT (US)

( * ) Notice: Subject to any disclaimer, the term of this patent is extended or adjusted under 35 U.S.C. 154(b) by 193 days.

(21) Appl. No.: 11/279,512

(22) Filed: Apr. 12, 2006

(65) Prior Publication Data

US 2006/0226002 A1 Oct. 12, 2006

(30) Foreign Application Priority Data

Apr. 12, 2005 (EP) ..... 05008042

(51) Int. Cl.
*C25B 11/03* (2006.01)
*C25B 11/04* (2006.01)

(52) U.S. Cl. ..... 204/284; 204/290.01; 204/292; 204/293

(58) Field of Classification Search ..... 205/246, 205/244, 305, 309, 366; 204/290.01, 284, 204/293, 292

See application file for complete search history.

(56) References Cited

U.S. PATENT DOCUMENTS

| | | | | |
|---|---|---|---|---|
| 3,607,706 | A | 9/1971 | Eisenmann et al. | |
| 4,033,837 | A | 7/1977 | Kuo et al. | |
| 4,214,964 | A * | 7/1980 | Cannell | 205/594 |
| 4,288,305 | A * | 9/1981 | Garritsen et al. | 205/587 |
| 4,337,141 | A | 6/1982 | Watanabe et al. | |
| 4,469,564 | A | 9/1984 | Okinaka et al. | |
| 5,141,606 | A * | 8/1992 | Matsumoto et al. | 205/712 |
| 5,972,192 | A | 10/1999 | Dubin et al. | |
| 6,099,711 | A | 8/2000 | Dahms et al. | |
| 6,120,658 | A * | 9/2000 | Dunn et al. | 204/279 |
| 6,602,394 | B1 | 8/2003 | Hillebrand | |
| 6,607,654 | B2 | 8/2003 | Lee et al. | |
| 6,610,192 | B1 | 8/2003 | Step et al. | |
| 2003/0085133 | A1 | 5/2003 | Totsuka et al. | |
| 2004/0089557 | A1 | 5/2004 | Tsuchida et al. | |
| 2004/0104123 | A1 | 6/2004 | Hillebrand | |
| 2005/0121332 | A1 | 6/2005 | Kochilla et al. | |
| 2005/0133376 | A1 * | 6/2005 | Opaskar et al. | 205/246 |
| 2006/0124454 | A1 * | 6/2006 | Wurm et al. | 204/286.1 |
| 2006/0226002 | A1 | 10/2006 | Mobius et al. | |
| 2006/0272951 | A1 * | 12/2006 | Schmergel et al. | 205/291 |

FOREIGN PATENT DOCUMENTS

| | | |
|---|---|---|
| DE | 26 52 152 A1 | 9/1977 |
| DE | 102 61 493 A1 | 7/2004 |

(Continued)

OTHER PUBLICATIONS

Abstract of JP1150000; Jun. 13, 1989.

(Continued)

*Primary Examiner*—Bruce F Bell
(74) *Attorney, Agent, or Firm*—Senniger Powers LLP

(57) ABSTRACT

The invention relates to an insoluble anode for electrolytic plating, the insoluble anode having two or more phases comprising an anode base body and a screen wherein the anode base body of steel, stainless steel, nickel, nickel alloy, cobalt, and cobalt alloy.

25 Claims, 1 Drawing Sheet

FOREIGN PATENT DOCUMENTS

| | | | |
|---|---|---|---|
| DE | 10261493 | A1 | 7/2004 |
| EP | 0 471 577 | A1 | 2/1992 |
| EP | 0625593 | A2 | 11/1994 |
| EP | 1 102 875 | B1 | 5/2001 |
| JP | 63014886 | A | 1/1988 |
| JP | 1150000 | | 6/1989 |
| JP | 1152294 | | 6/1989 |
| WO | 2004038070 | A2 | 5/2004 |
| WO | 2004/059045 | A2 | 7/2004 |
| WO | 2004/108995 | A1 | 12/2004 |

OTHER PUBLICATIONS

Abstract of JP1152294; Jun. 14, 1989.
Abstract of WO2004/059045; Jul. 15, 2004.
Abstract of DE10261493; Jul. 8, 2004.

* cited by examiner

INSOLUBLE ANODE

CROSS REFERENCE TO RELATED APPLICATIONS

This application claims priority from EP patent application number 05008042.3, the entire disclosure of which is explicitly incorporated by reference.

FIELD OF THE INVENTION

The invention relates to an insoluble anode for use in an electrolytic plating composition and method.

BACKGROUND OF THE INVENTION

Electrolytic plating methods, for example copper-plating, nickel-plating, cobalt and cobalt alloy-plating, zincing, or tinning, are carried out by means of soluble or insoluble anodes. When soluble anodes, also known as active anode systems, are used in an electrolytic plating operation, the anode dissolves during plating. The anode comprises a salt of the metal ion being plated. Accordingly, a balance between the dissolution of the soluble anode during plating to yield additional metal ion in the plating bath and metal ion reduction at the cathode allows for careful control of a steady state concentration of metal ion in solution. Insoluble anodes, also referred to as inert anode systems, do not dissolve during the electrolysis because insoluble anodes are constituted of an inert material. Typically, insoluble anodes comprise a carrier material coated with an active layer material. Typical carrier materials, including titanium, niobium, stainless steel, and other inert metals such as valve metals, become passive, i.e., non-corroding, under electrolysis conditions. Typical active layer materials, which are electron-conductive materials, include platinum, iridium, ruthenium, other precious metals, mixed oxides thereof, or compounds of these elements. Herein, the active layer can either be directly applied on the surface of the carrier material or can be placed on a substrate, which is spaced with respect to the carrier material. Substrate materials include the same types of materials appropriate for use as carrier materials, for example stainless steel, titanium, and the like.

Generally, electrolytic plating can be carried out by means of direct-current, pulse current, or pulse reverse current.

Additives are typically added to electrolytic plating baths, which additives act, for example, as brighteners, to increase the deposit hardness and/or the dispersion. Herein, organic compounds are preferably used as additives.

During the electrolytic plating operation, gases, for example oxygen or chlorine, are generated at the insoluble anode. These gases can oxidize organic additives contained in the electrolytic plating bath, which can lead to partial or even complete decomposition of these additives. Decomposition of the organic additives is disadvantageous for at least a couple reasons. First, the additives have to be periodically replenished. Second, degradation products of the additives cause disturbances, such that it becomes necessary to frequently renew or purify or regenerate the electrolytic plating baths, which is neither economically nor ecologically reasonable.

EP 1 102 875 B1 discloses a method for inhibiting organic additive oxidation in an alkaline electrolytic plating bath by separating the anode from the cathode with an ion exchanger membrane. This design has the advantage that organic compounds are isolated from the anode, which effectively prevents oxidation of the additives. However, this design requires more instrumentation, since the electrolytic plating bath requires a closed box with an anolyte around the anode and a catolyte around the cathode. Additionally, a higher voltage is required, which questions the economic efficiency of the design. Importantly, the structural solution proposed by EP 1 102 875 B1 is not applicable to every anode-cathode geometry, such as for coating the interior of tubes.

DE 102 61 493 A1 discloses an anode for electrolytic plating, which comprises an anode base body and a screen. The anode base body comprises a carrier material and a substrate having an active layer. The screen of the anode base body is located at a fixed distance from the anode base body and reduces the mass transport towards the anode base body and away from it. In contrast to the design according to EP 1 102 875 B1, the use of such an anode requires less instrumentation and also has the advantage that the additives contained in the electrolytic plating bath do not oxidize to such a high extent.

However, the anode described in DE 102 61 493 A1 is expensive. The anode base body of the anode is formed by combining two parts, and the fabrication process is both effort-intensive and expensive. The anode base body comprises a carrier material and an active layer. Titanium is typically used as carrier material. The active layer, however, comprises expensive noble materials such as platinum, iridium, mixed oxides of platinum metals, and diamonds. The anode described in DE 102 61 493 A1 is comparatively expensive, whereby the economic efficiency of an electrolytic plating method using such an anode is doubtful.

SUMMARY OF THE INVENTION

Among the various aspects of the present invention may be noted a multi-phase insoluble anode manufactured by an inexpensive method using inexpensive materials. The aim is achieved in that the invention proposes an insoluble anode for electrolytic plating which is multi-phase and comprises an anode base body and a screen wherein the anode base body does not contain noble metals, but rather is constructed entirely from materials such as steel, stainless steel, nickel, nickel alloys, cobalt, or cobalt alloys.

Therefore, the invention is directed to an insoluble anode for use in an electrolytic plating bath, the insoluble anode comprising an anode base body having a non-noble metal outer surface and comprising a metal base body material which is conductive in alkaline solutions and is selected from the group of materials consisting of steel, stainless steel, nickel, nickel alloy, cobalt, and cobalt alloy, and a screen.

The invention is also directed to an insoluble anode for use in an electrolytic plating bath, the insoluble anode comprising a one-piece anode base body comprising a metal base body material which is conductive in alkaline solutions and is selected from the group of materials consisting of steel, stainless steel, nickel, nickel alloy, cobalt, and cobalt alloy, and a screen.

In another aspect the invention is directed to a method for electrolytic plating of a metal deposit onto a substrate comprising immersing the substrate into an alkaline electrolytic plating bath comprising a source of metal ions; and supplying electrical current to the electrolytic plating bath to deposit metal onto the substrate and fill the feature, wherein the current is supplied via an insoluble anode comprising a screen and an anode base body having a non-noble metal outer surface and comprising a metal base body material which is conductive in alkaline solutions and is selected from the group consisting of steel, stainless steel, nickel, nickel alloy, cobalt, and cobalt alloy.

The invention also comprises an electrolytic plating bath and apparatus for electrolytically plating a metal onto a substrate comprising a plating tank; an alkaline electrolytic plating composition in the plating tank, wherein the electrolytic plating composition comprises a source of metal ions; a cathode; and an insoluble anode comprising a screen and an anode base body having a non-noble metal outer surface and comprising a metal base body material which is conductive in alkaline solutions and is selected from the group consisting of steel, stainless steel, nickel, nickel alloy, cobalt, and cobalt alloy.

Other objects and features will be in part apparent and in part pointed out hereinafter.

BRIEF DESCRIPTION OF THE DRAWINGS

Other advantages and characteristics of the invention will result from the following description made with reference to the figures. Herein.

DETAILED DESCRIPTION OF THE PREFERRED EMBODIMENTS

Figure 1:
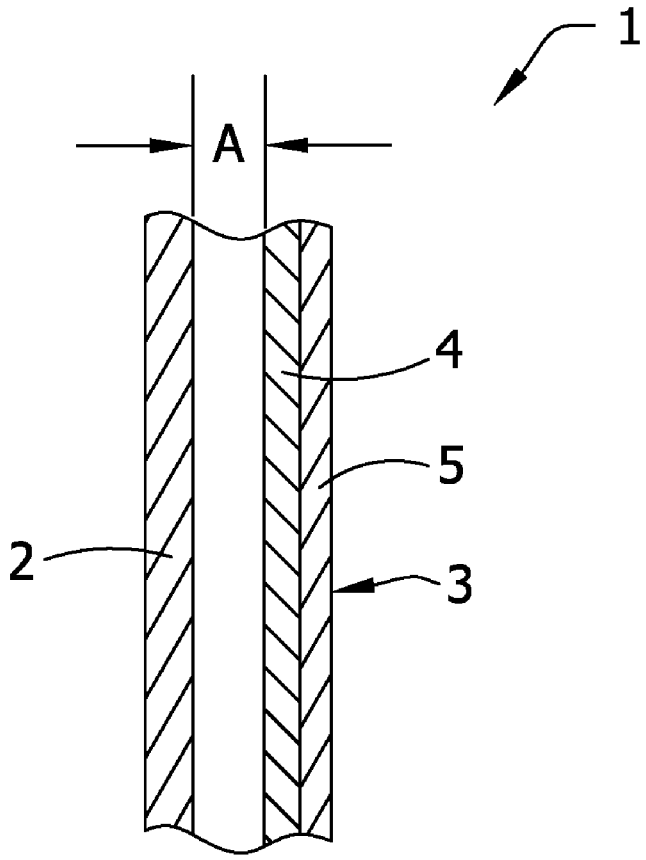
FIG. 1 is a schematic section of an anode according to the invention in the form of a plate.

The anode according to the invention is multi-phase (i.e., more than one phase) and comprises an anode base body and a screen. In contrast to the anode base body described in DE 102 61 493 A1, the anode base body of the present invention does not comprise an active layer constructed of expensive noble metals. Rather, it is constructed of an anode base body material selected from among steel, stainless steel, nickel, nickel alloy, cobalt, and cobalt alloy. Exemplary nickel based alloys include the Hastelloy alloys available from Haynes International, Inc. (Kokomo, Ind.). The outer surface of the anode base body is non-noble metal, meaning that it is a metal material which is not based on a noble metal. In the preferred embodiments the outer surface comprises the steel, stainless steel, nickel, nickel alloy, cobalt, and cobalt alloy of the anode base body, or in another embodiment a non-noble plating such as nickel, cobalt, and cobalt alloy plating on steel. Accordingly, the anode according to the invention advantageously comprises cheaper materials and is less expensive to produce, which allows a more economic operation, in particular with alkaline zinc or zinc alloying baths.

Surprisingly it has been found that alkaline zinc bath, zinc alloying bath, gold bath, silver bath, palladium bath, platinum bath, tin bath, tin alloying bath, or bronze bath do not require a two-piece anode consisting of a carrier material and a noble metal active layer; and that excellent coating results can also be obtained by means of a comparatively simple anode, the anode base body of which is constructed of materials such as steel and stainless steel alloys including nickel, cobalt, and cobalt alloy plated steel and nickel/cobalt plated steel, and nickel, nickel alloy, cobalt, and cobalt alloy. Exemplary nickel alloys include the Hastelloy alloys, which are alloys comprising predominantly nickel with molybdenum, chromium, and cobalt as major components in varying proportions. The use of the anode according to the invention thus proves to be much more economic in comparison to the anode known from DE 10261 493 A1.

The anode according to the invention is suitable for electrolytic plating compositions, which work with inert anodes, for example also for high-speed devices, as well as for electrolytic plating compositions with bivalent tin or other easily oxidized components. The anode according to the invention inhibits oxidation of bath components or additives. For example, the anode inhibits the oxidation of tin(II) to tin (IV).

The electrolytic plating bath of the present invention employs a multi-phase anode. With regard to the multi-phase anode, the term "multi-phase" is meant to describe an anode comprising a base body and one screen or more than one screen. The simplest anode configuration, in which the anode comprises a base body and one screen can be referred to as a "bi-phase" anode. Accordingly, the anode base body is the first phase, and the screen is the second phase. An anode configuration in which the anode comprises a base body and two screens can be referred to as a "tri-phase" anode. The anode base body itself is constructed of materials such as steel and stainless steel alloys including nickel, cobalt, and cobalt alloy plated steel and nickel/cobalt plated steel, and cobalt, cobalt alloy, nickel, and nickel alloy, such as the Hastelloy alloys. Typically, anode base bodies constructed of these materials are shaped as plates, rods, and tubes. Plates are typically about 10 cm to about 20 cm in width, about 2 mm thick, and about 1 m to about 1.5 m in length. Rods are typically about 10 mm to about 20 mm in diameter and about 1 m to about 1.5 m in length. Tubes are typically about 5 cm to about 10 cm in diameter and about 1 m to 1.5 m in length, which are closed at the end which is exposed to the metal plating baths.

The screen of the anode is disposed around the anode in a manner in which the screen is in direct contact with the anode base body and forms a bag which envelopes the anode base body, or the anode base body is enveloped by the screen in a manner which minimally separates the screen from direct contact with the anode base body. Accordingly, the screen is disposed in such a manner in which the screen is wrapped around the base body, or in a manner in which the distance between the screen and the base body is less than about 2 mm, preferably less than about 1 mm. The screen can be composed of non-conductive material, such as plastic or glass, or a self-passivating metal (i.e., does not flow a current) such as titanium. The screen can be a fabric, a net, or a grid. These terms used to describe the types of screens differentiate the screens with respect to their flexibility. That is, a fabric is a flexible screen, while a grid, which is a woven, expanded metal, is the most rigid. A net has flexibility intermediate that of a fabric or a grid.

In one embodiment, the screen comprises a grid or net made of self-passivating metal (i.e., does not flow a current) such as titanium or valve metals. Exemplary valve metals include niobium, zirconium, hafnium, lanthanum, tantalum, and tungsten, and alloys thereof. The grid or screen can have a mesh size of about 1 mm.

In one embodiment, the screen is formed by a fabric made of non-conductive material such as organic materials or inorganic, non-metallic materials. Exemplary organic materials include polypropylene, polyethylene, polyvinylchloride (PVC), chlorinated PVC, PC, cotton fibers, or linens. Exemplary inorganic, non-metallic materials include glass fibers and mineral fibers, such as fiberglass, glass wool, glass filament, and refractory ceramic fibers (RCF). The fabric can be formed into a porous diaphragm, such as a bag which surrounds and envelopes the anode base body. The fabric comprises an interwoven network of fibers, the fibers woven horizontally and vertically in a grid-like fashion. The fabric materials can include polypropylene fibers, glass fibers, and mineral fibers. Accordingly, the diameter of the fibers is typically between about 0.1 mm and about 0.5 mm, and the porous spaces between the fibers are typically no more than about 0.5 mm. In embodiments where the anode is shaped like a rod or tube, preferably, the anode screen comprises a fabric, wrapped like a sock, around the anode base body.

Preferably, the multi-phase anode comprises a two-part screen, wherein the first part of the screen is formed by a grid or network made of titanium and the second part of the screen is a fabric made of polypropylene. This particular two-part screen is preferred for a flat anode. The titanium has in connection with the steel, stainless steel, nickel, nickel alloy, cobalt, or cobalt alloy anode a positive potential, but because of its self-passivating properties does not flow a current. The positive potential reduces the diffusion/migration of positive charged ions to the anode surface, which yields better results. Herein, the fabric made of polypropylene is placed between the anode body and the grid or network made of titanium. Accordingly, the anode is a tri-phase anode.

The bi-phase or multi-phase electrode system inhibits contamination of the electrolytic plating composition with oxygen by blocking the diffusion of oxygen into the bulk of the electrolytic plating composition. Rather, the oxygen is retained by the screen or screens surrounding the anode base body. Oxygen present in excess of its solubility in water diffuses to the surface of the electrolytic composition rather than oxidizing organic additives and degrading the bath quality. Accordingly, the screen/fabric system is open at the surface of the bath to permit gas to escape.

The electrolytic plating bath according to the invention thus proves to be especially economic. The oxidation of organic additives is substantially reduced because the oxygen concentration in the electrolytic plating composition is controlled. This allows for considerable delay of purification of the electrolytic plating composition, for example by means of active carbon treatment or classic oxidative treatment. Laboratory investigations, which have been carried out in this context, show that the operating time of the electrolytic plating bath according to the invention could be increased by 300% or more in comparison to electrolytic plating baths known in the art.

FIG. 1 depicts an exemplary multi-phase anode in a partially sectional side view. Anode 1 has the form of a plate and comprises an anode base body 2 and a screen 3.

As can be seen in FIG. 1, said screen 3 is spaced with respect to the anode base body, wherein the distance between anode base body 2 and screen 3 is referenced with "A".

Depending on the application, said distance A between anode base body 2 and screen 3 can be between about 0.01 mm and about 50 mm, preferably between about 0.05 mm and about 5 mm, more preferably between about 0.5 mm and about 1 mm.

According to the exemplary embodiment of FIG. 1, said screen 3 is formed by two pieces. It comprises a polypropylene fabric 4 and a metal grid 5 made of platinum. The polypropylene fabric 4 is placed between said anode base body 2 and said metal grid 5. Said metal grid 5 can be connected to anode base body 2 in an electrically conductive way, which is not represented in FIG. 1 for the sake of clarity.

Anode I shown in FIG. 1 is three-phase. A first phase is provided by anode base body 2. The second and third phase result from screen 3, wherein the second phase is formed by said polypropylene fabric 4 and the third phase is formed by said metal grid 5.

According to the exemplary embodiment of FIG. 1, screen 3 is only placed on one side of anode base body 2. The screen 3 can also be placed on the other side, i.e. on the left side of anode base body 2 with respect to the sheet plane of FIG. 1.

Figure 2:
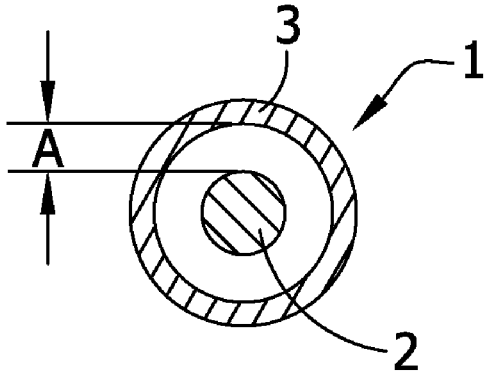
FIG. 2 is a schematic section of an anode according to the invention in the form of a bar.

FIG. 2 is a schematic sectional view from above of another exemplary embodiment of anode 1 according to the invention. Anode 1 of FIG. 2 comprises an anode base body 2 and a screen 3, in correspondence to the exemplary embodiment according to FIG. 1. In contrast to the exemplary embodiment of FIG. 1, anode 1 according to FIG. 2 is not formed as a plate, but with respect to the cross section thereof is formed as a circle, like a bar. Screen 3 surrounds anode base body 2 completely in the form of an envelope. In contrast to the exemplary embodiment of FIG. 1, screen 3 according to the exemplary embodiment of FIG. 2 is single-phase and comprises, for example, a metal grid or a plastic fabric. Distance A between anode base body 2 and screen 3 corresponds to distance A according to the exemplary embodiment of FIG. 1.

In both exemplary embodiments the anode base body 2 is constructed from a material selected from among, for example, steel, stainless steel, or nickel, nickel alloy, cobalt, and cobalt alloy. The following list of reference numbers is provided for convenience:

Anode—1
anode base body—2
screen—3
polypropylene fabric—4
metal grid—5
distance—A The present invention is also directed to an electrolytic plating bath, in particular an alkaline electrolytic plating bath, comprising an insoluble anode according to the above mentioned characteristics. For example, the insoluble anode can be used in electrolytic plating baths including alkaline zinc and zinc alloying baths, gold baths, silver baths, palladium baths, platinum baths, tin baths, tin alloying baths, and bronze baths.

A zinc or zinc alloy electrolytic plating bath can have the following components:

i. A source of zinc ion such as solid zinc (which may be zinc oxide, zinc chloride, etc.) in the form of zinc plates, zinc rods, or zinc particles in an basket in a so-called dissolution compartment sufficient to provide a concentration of zinc ion between about 10 g/L and about 20 g/L
ii. NaOH present in a concentration between about 110 g/L and about 180 g/L, such that a ratio NaOH:Zn can be between about 13:1 to about 10:1
iii. Grain refiners, brighteners, and other additives, such as those present in Enthobrite® NCZ Dimension A (10 mL/L to 20 mL/L), Enthobrite® NCZ Dimension B (0.1 mL/L to 5 mL/L), Enthobrite® NCZ C (1 mL/L to 5 mL/L), and Enthobrite® NCZ Conditioner (all available from Enthone Inc., West Haven, Conn.)
iv. Bath soluble polymer described in U.S. Pat. No. 5,435,898, sold under the trade name MIRAPOL® WT, CAS No. 68555-36-2, available from Rhone-Poulenc (about 0.5 g/L to about 3 g/L).

Exemplary plating baths for other metals are listed below:

Alkaline gold baths: Aurobond® OP or Ultraclad® 920

Alkaline palladium and palladium alloy baths: Palladex® 300 and Palladex® 800

Alkaline nickel, nickel alloy, cobalt, and cobalt alloys baths

Alkaline Platinum bath: Platinart® 100

Cyanide baths including cyanide copper baths, cyanide silver baths, and cyanide gold baths.

Cyanide bronze baths like Bronzex® WMF.

All of these electrolytic plating compositions are available from Enthone Inc.

The present invention is further directed to a method for electrolytic plating, which uses an insoluble anode according to the above mentioned characteristics. Exemplary substrates include steel and zinc die casts.

Plating equipment comprises an electrolytic plating tank which holds electrolytic plating solution and which is made of a suitable material such as plastic or other material inert to the electrolytic plating solution. The tank may be cylindrical, especially for wafer plating. A cathode is horizontally or vertically disposed at the upper part of the tank and may be any type substrate such as steel and zinc die casts.

The cathode substrate and anode are electrically connected by wiring and, respectively, to a rectifier (power supply). The cathode substrate for direct or pulse current has a net negative charge so that metal ions in the solution are reduced at the cathode substrate forming plated metal on the cathode surface. An oxidation reaction takes place at the anode. The cathode and anode may be horizontally or vertically disposed in the tank.

During operation of the electrolytic plating system, metal is plated on the surface of a cathode substrate when the rectifier is energized. A pulse current, direct current, reverse periodic current, or other suitable current may be employed. Preferably, plating is carried out by means of direct current. The temperature of the electrolytic solution may be maintained using a heater/cooler whereby electrolytic solution is removed from the holding tank and flows through the heater/cooler and then is recycled to the holding tank.

Electrolysis conditions such as electric current concentration, applied voltage, electric current density, and electrolytic solution temperature are essentially the same as those in conventional electrolytic plating methods. For example, the bath temperature is typically about room temperature such as about 20-27° C., but may be at elevated temperatures up to about 40° C. or higher. The electrical current density is typically up to about 100 mA/cm$^2$, typically about 2 mA/cm$^2$ to about 60 mA/cm$^2$. It is preferred to use an anode to cathode ratio of about 1:1, but this may also vary widely from about 1:4 to 4:1. The process also uses mixing in the electrolytic plating tank which may be supplied by agitation or preferably by the circulating flow of recycled electrolytic solution through the tank. The flow through the electrolytic plating tank provides a typical residence time of electrolytic solution in the tank of less than about 1 minute, more typically less than 30 seconds, e.g., 10-20 seconds.

By using the electrolytic plating bath according to the methods described herein, a fine crystal structure can be obtained, which leads to improved physical properties of the deposited layer.

The following examples further illustrate the present invention.

Example 1

Zinc/Nickel Alloy Electrolytic Plating Composition

A zinc/nickel alloy electrolytic plating composition was prepared using Zincrolyte® NCZ Ni 316 chemistry available from Enthone Inc. (West Haven, Conn.) The bath contained the following components:

Zinc(II) ions (8.5 g/L)

NaOH (120 g/L)

Zincrolyte® NCZ Ni 316 Carrier (50 mL/L)

Zincrolyte® NCZ Ni 316 Nickel (12 mL/L)

Zincrolyte® NCZ Ni 316 Brightener (1.5 mL/L)

Water balance.

This bath was prepared according to the following protocol:

Fill a cleaned glass 3 L beaker with demineralised water (600 mL).

Slowly add and dissolve NaOH (300 g). This is done slowly to avoid overheating the solution.

Add ZnO (26.5 g) and stir to dissolve.

Add water to 2000 mL.

Allow the solution to cool to room temperature.

Add with stirring the additives required in the following order:

a) ZINCROLYTE NCZ Ni 316 Carrier (125 mL)

b) ZINCROLYTE NCZ Ni 316 Nickel (30 mL)

c) ZINCROLYTE NCZ Ni 316 Brightener (3.75 mL)

Add water to final volume of 2.5 L.

Example 2

Evaluation of Bi-Phase Anode Using Zinc Electrolytic Plating Compositions

Three baths were prepared using the zinc electrolytic plating composition of Example 1. Each bath comprised 2.5 L of the plating composition, steel sheet for use as a cathode, and nickel-plated steel, nickel alloy-plated steel, and nickel/cobalt alloy-plated steel for the anodes. The anode and applied current density for each bath are shown in the following table:

| Bath | Anode | Current Density |
|---|---|---|
| 1 | Nickel-plated steel covered with polypropylene cloth | 2 A/dm$^2$ |
| 2 | Nickel alloys-plated steel | 2 A/dm$^2$ |
| 3 | Nickel/cobalt alloy-plated steel | 8 A/dm$^2$ |

Baths 1 and 2 employed anode plates having dimensions of 8 cm width by 12 cm length. Bath 3 employed an anode plate having dimensions of 2 cm width by 12 cm length.

Polypropylene cloth was wrapped tightly over the nickel-plated steel anode for use in Bath 1 with a coated steel wire. Current was applied to the baths for an extended period at room temperature, and bath components were not replenished during the experiment. At certain intervals, samples were removed and analyzed for carrier concentration. The depletion of Zincrolyte® carrier as a function of Amp hours/Liter is shown in the following table.

| Amp hours/Liter | Bath 1 | Bath 2 | Bath 3 |
|---|---|---|---|
| 0 | 62.7 mL/L | 62.7 mL/L | 62.7 mL/L |
| 26 | 61.4 mL/L | 56.3 mL/L | 68.5 mL/L |
| 38 | 56.3 mL/L | 52.9 mL/L | 68.6 mL/L |
| 62.4 | 58.2 mL/L | 50.9 mL/L | 68.2 mL/L |
| Corrected for Evaporation | 52.4 mL/L | 45.8 mL/L | 61.3 mL/L |

These results indicate that application of a polypropylene cloth over the anode resulted in a reduced consumption of the Zincrolyte® NCZ Ni 316 Carrier. The small area anode with high applied current density resulted in the least consumption of the carrier.

Example 3

Evaluation of Tri-Phase Anode Using Zinc Electrolytic Plating Compositions

Three baths were prepared using the zinc electrolytic plating composition of Example 1. Each bath comprised 2.5 L of the plating composition, steel sheet for use as a cathode, and nickel alloy-plated steel for the anode. The area of the steel sheet cathode exposed to the composition was 1.8 $dm^2$, and the cathode current density was 1.9 $A/dm^2$. The anode and applied current density for each bath are shown in the following table:

| Bath | Anode | Current Density |
|---|---|---|
| 1 | Nickel-plated steel | 1.9 $A/dm^2$ |
| 2 | Nickel-plated steel covered with Titanium mesh | 1.9 $A/dm^2$ |
| 3 | Nickel-plated steel covered with Titanium mesh and with polypropylene cloth | 1.9 $A/dm^2$ |

Polypropylene cloth was wrapped tightly over the Titanium-mesh covered nickel-plated steel anode for use in Bath 3 with a coated steel wire.

Current was applied to the bath for an extended period at room temperature, and bath components were not replenished during the experiment. At certain intervals, samples were removed and analyzed for carrier concentration. The depletion of Zincrolyte® carrier as a function of Amp hours/Liter is shown in the following table.

| Amp hours/Liter | Bath 1 | Bath 2 | Bath 3 |
|---|---|---|---|
| 0 | 43.18 mL/L | 45.24 mL/L | 44.98 mL/L |
| 6.3 | 38.11 mL/L | 40.88 mL/L | 44.04 mL/L |
| 30.8 | 28.76 mL/L | 32.07 mL/L | 35.45 mL/L |
| 42.0 | 25.60 mL/L | 28.73 mL/L | 33.08 mL/L |
| 62.3 | 22.52 mL/L | 25.84 mL/L | 28.15 mL/L |
| 73.5 | 20.20 mL/L | 24.82 mL/L | 26.71 mL/L |
| 168.0 | 11.95 mL/L | 19.92 mL/L | 20.60 mL/L |
| Total Consumed | 31.23 mL/L | 25.32 mL/L | 24.38 mL/L |
| L/10.0 Amp hours | 1.86 | 1.51 | 1.45 |

These results indicate that application of a titanium mesh over the anode resulted in a reduced consumption of the Zincrolyte® NCZ Ni 316 Carrier. Covering the titanium mesh with a polypropylene cloth resulted in an even greater reduction in the consumption of the Zincrolyte® NCZ Ni 316 Carrier.

In view of the above, it will be seen that the several objects of the invention are achieved and other advantageous results attained.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above methods and products without departing from the scope of the invention, it is intended that all matter contained in the above description and shown in any accompanying drawings shall be interpreted as illustrative and not in a limiting sense.

What is claimed is:

1. An insoluble anode for use in an electrolytic plating bath, the insoluble anode comprising:

an anode base body having a non-noble metal outer surface and comprising a metal base body material which is conductive in alkaline solutions and is selected from the group of materials consisting of steel, stainless steel, nickel, nickel alloy, cobalt, and cobalt alloy; and a screen which is a grid or network constructed of a self-passivating metal.

2. The insoluble anode of claim 1 wherein the self-passivating metal is selected from the group consisting of titanium, niobium, zirconium, hafnium, lanthanum, tantalum, tungsten, and alloys thereof.

3. An insoluble anode for use in an electrolytic plating bath, the insoluble anode comprising:

an anode base body having a non-noble metal outer surface and comprising a metal base body material which is conductive in alkaline solutions and is selected from the group of materials consisting of steel, stainless steel, nickel, nickel alloy, cobalt, and cobalt alloy; and a screen which is fabric constructed of material selected from the group consisting of fiberglass, glass wool, glass filament, and refractory ceramic fibers (RCF).

4. An insoluble anode for use in an electrolytic plating bath, the insoluble anode comprising:

an anode base body having a non-noble metal outer surface and comprising a metal base body material which is conductive in alkaline solutions and is selected from the group of materials consisting of steel, stainless steel, nickel, nickel alloy, cobalt, and cobalt alloy; and a screen which comprises a first piece constructed of plastic and a second piece constructed of metal.

5. The insoluble anode of claim 4 wherein the screen comprises a grid or network constructed of titanium and a fabric constructed of polypropylene, and the polypropylene fabric is located between the anode base body and the titanium grid or network.

6. The insoluble anode of claim 5 wherein said fabric comprises an interwoven network of fibers.

7. The insoluble anode of claim 5 wherein the non-noble metal outer surface is a material selected from the group consisting of steel, stainless steel, nickel, nickel alloy, cobalt, and cobalt alloy.

8. The insoluble anode of claim 4 wherein the non-noble metal outer surface is a material selected from the group consisting of steel, stainless steel, nickel, nickel alloy, cobalt, and cobalt alloy.

9. An insoluble anode for use in an electrolytic plating bath, the insoluble anode comprising:

an anode base body having a non-noble metal outer surface and comprising a metal base body material which is conductive in alkaline solutions and is selected from the group of materials consisting of steel, stainless steel, nickel, nickel alloy, cobalt, and cobalt alloy; and a screen which is connected to the anode base body in an electrically conductive way.

10. The insoluble anode of claim 9 wherein the screen is disposed around the anode with a spacing between the screen and the anode base body.

11. The insoluble anode of claim 10 wherein the screen is constructed from a non-conductive material or a self-passivating metal.

12. The insoluble anode of claim 10 wherein the screen is formed as a grid, network, or fabric.

13. The insoluble anode of claim 12 wherein the screen is a fabric comprising an interwoven network of fibers.

14. The insoluble anode of claim 13 wherein the fabric is constructed of an organic material is selected from the group consisting of polypropylene, polyethylene, polyvinylchloride (PVC), chlorinated PVC, PC, cotton fibers, and linens.

15. The insoluble anode of claim 13 wherein the fabric is constructed from a polypropylene.

16. The insoluble anode of claim 9 wherein the non-noble metal outer surface is a material selected from the group consisting of steel, stainless steel, nickel, nickel alloy, cobalt, and cobalt alloy.

17. The insoluble anode of claim 9 wherein the screen comprises a fabric constructed of an organic material selected from the group consisting of polypropylene, polyethylene, polyvinylchloride (PVC), chlorinated PVC, PC, cotton fibers, and linens.

18. The insoluble anode of claim 17 wherein the fabric is constructed from a polypropylene.

19. The insoluble anode of claim 9 wherein the screen is disposed around the anode with a spacing between the screen and the anode base body.

20. An insoluble anode for use in an electrolytic plating bath, the insoluble anode comprising:

a one-piece anode base body having an outer surface and comprising a metal base body material which is conductive in alkaline solutions and is selected from the group consisting of steel, stainless steel, nickel, nickel alloy, cobalt, and cobalt alloy; and a screen wherein the screen is disposed around the anode with a spacing between the screen and the anode base body;

wherein the screen is fabric constructed of material selected from the group consisting of fiberglass, glass wool, glass filament, and refractory ceramic fibers (RCF).

21. An insoluble anode for use in an electrolytic plating bath, the insoluble anode comprising:

a one-piece anode base body having an outer surface and comprising a metal base body material which is conductive in alkaline solutions and is selected from the group consisting of steel, stainless steel, nickel, nickel alloy, cobalt, and cobalt alloy; and a screen wherein the screen is disposed around the anode with a spacing between the screen and the anode base body;

wherein the screen is a grid or network constructed of a self-passivating metal.

22. The insoluble anode of claim 21 wherein the self-passivating metal is selected from the group consisting of titanium, niobium, zirconium, hafnium, lanthanum, tantalum, tungsten, and alloys thereof.

23. An insoluble anode for use in an electrolytic plating bath, the insoluble anode comprising:

a one-piece anode base body having an outer surface and comprising a metal base body material which is conductive in alkaline solutions and is selected from the group consisting of steel, stainless steel, nickel, nickel alloy, cobalt, and cobalt alloy; and a screen wherein the screen is disposed around the anode with a spacing between the screen and the anode base body;

wherein the screen comprises a first piece constructed of plastic and a second piece constructed of metal.

24. The insoluble anode of claim 23 wherein the screen is in contact with the anode base body.

25. The insoluble anode of claim 23 wherein the screen comprises a grid or network constructed of titanium and a fabric constructed of polypropylene, and the polypropylene fabric is located between the anode base body and the titanium grid or network.

* * * * *